United States Patent [19]

Vosmeyer et al.

[11] Patent Number: 4,515,111

[45] Date of Patent: May 7, 1985

[54] AIR-COOLED, RECIPROCATING PISTON, INTERNAL COMBUSTION ENGINE WITH CYLINDER HEADS FORMING ARCUATE OR S-SHAPED COOLING DUCTS THEREBETWEEN

[75] Inventors: Wilhelm Vosmeyer, Beaconsfield; Roderick Cole, Kirkland; Pavel J. Slezak, Quebec, Canada

[73] Assignee: KHD Canada Inc., Quebec, Canada

[21] Appl. No.: 601,961

[22] Filed: Apr. 19, 1984

[51] Int. Cl.[3] ..... F01P 1/02

[52] U.S. Cl. ..... 123/41.61; 123/41.69

[58] Field of Search ..... 123/41.56, 41.58, 41.6, 123/41.61, 41.62, 41.68, 41.7

[56] References Cited

U.S. PATENT DOCUMENTS

| | | | |
|---|---|---|---|
| 2,467,992 | 4/1949 | Riple, Jr. | 123/41.6 |
| 2,691,366 | 10/1954 | Flatz et al. | 123/41.69 |
| 2,729,201 | 1/1956 | Rohm | 123/41.6 |
| 3,079,902 | 3/1963 | Ulbrich | 123/41.69 |
| 3,650,250 | 3/1972 | Lohr et al. | 123/41.69 |
| 3,782,344 | 1/1974 | Schmuck | 123/41.69 |
| 4,216,746 | 8/1980 | Freyn | 123/41.69 |

FOREIGN PATENT DOCUMENTS

| | | | |
|---|---|---|---|
| 1174949 | 3/1959 | France | 123/41.69 |

*Primary Examiner*—William A. Cuchlinski, Jr.
*Attorney, Agent, or Firm*—Watson, Cole, Grindle & Watson

[57] ABSTRACT

An air-cooled, reciprocating piston, internal combustion engine which includes at least one cylinder head which includes inlet and exhaust ducts having inlet and exhaust valves with stems, the stems extending parallel to one another, said valve stems being oriented with respect to a longitudinal axis of the engine such that a plane passing therethrough will lie at an acute angle to the longitudinal axis of the engine. The external walls of the cylinder heads which provide the inlet and exhaust ducts, together with a central area arranged between the ducts, form, in the cylinder head section facing away from the cylinder, at least one arcuate or S-shaped cooling air duct when positioned adjacent a similarly constructed cylinder head.

13 Claims, 5 Drawing Figures

AIR-COOLED, RECIPROCATING PISTON, INTERNAL COMBUSTION ENGINE WITH CYLINDER HEADS FORMING ARCUATE OR S-SHAPED COOLING DUCTS THEREBETWEEN

BACKGROUND OF THE INVENTION

1. Field of the Invention

The present invention relates to an air-cooled, reciprocating piston, internal combustion engine having at least one row of cylinders and individual cylinder heads arranged side-by-side, each row of cylinder heads being provided with lateral defectors adjacent the end cylinders thereof, and each cylinder head in each row including means such as bosses for accommodating attachment bolts. More particularly, the present invention relates to such internal combustion engines wherein each of the cylinder heads thereof has at least one inlet valve and one exhaust valve, the valve stems extending substantially parallel to the axis of the associated cylinder and being situated such that a plane passing therethrough lies at an acute angle to the longitudinal direction of the internal combustion engine, and wherein each cylinder head includes an intake duct located on a side thereof swept by cooling air (its inlet opening being located approximately centrally of the cylinder head), and an exhaust duct extending substantially perpendicularly to the exhaust air or exit side.

2. The Prior Art

An air-cooled, reciprocating piston, internal combustion engine of the foregoing type is available as commercial engine series 924 to 930 of the Tetra-Werke, Czechoslovakia, it being illustrated and described in the technical publication entitled, "Air Cooled Automobile Engines," by J. MacKerle, Frank'sche Verlagsbuchhandlung, Stuttgart, 1964, pages 171 to 173 and 524 to 528. The design of the cylinder heads and cooling ribs thereof is such that each cylinder head constitutes a cooling unit per se through which air flows in substantially straight lines. Thus, one cylinder head and its associated lateral deflectors forms merely a restriction for the flow of air to the other cylinder head. However, reciprocating piston, internal combustion engines with cylinder heads of this latter kind are suitable only for limited outputs, since the area of the exhaust ducts, in particular, and the areas between the exhaust duct and the cylinder barrel, cannot be adequately cooled. This is also due to the fact that the bosses for the cylinder head attachment bolts extend, in the crankcase, to the upper edge of the cylinder head.

It is therefore a main purpose of the present invention to improve the air-cooled, reciprocating piston, internal combustion engine in question, and the cylinder heads and cooling thereof, in such a manner such that higher outputs can be achieved, such that satisfactory guidance of the cooling air and satisfactory cooling of hot spots is achieved, and such that the production costs are favorable.

SUMMARY OF THE INVENTION

The aforementioned aim is achieved by designing the cylinder heads of such air-cooled, reciprocating piston, internal combustion engines, each of which includes inlet and exhaust ducts, central areas between the respective valve stems, and cooling ribs extending at right angles to the axis of the cylinder, such that their external surfaces provide arcuate or S-shaped cooling air ducts therebetween in their cylinder head sections facing away from the cylinder; and by providing their cover plate sections, facing the cylinder, with cooling ribs at their peripheries, substantially on the exhaust air side and on the side facing the inlet valve stem and with bosses for accommodating attachment bolts. Although each cylinder head according to the present invention is in one piece, it may be divided into a cylinder head section ("fin section") facing away from the cylinder and a cover plate section ("deck section"). The cover plate section is made thick enough to achieve adequate strength and to ensure overall stable and uniform sealing to the cylinder barrel. The bosses for the cylinder head attachment bolts also terminate at the cover plate section, so that the cylinder head section thereabove, facing away from the cylinder, is defined by the inlet and exhaust ducts, the cooling ribs, and a central area. The plane passing through the valve stems lies preferably at an acute angle of 30 in relation to the longitudinal axis of the internal combustion engine. Since the inlet duct, curved in the form of a hook, extends from the valve to the center of the cylinder head, and the exhaust duct runs by the shortest path thereto, substantially at right angles to the exhaust air side, such produces an arcuate or S-shaped cooling air duct—when two assembled cylinder heads are viewed from above. Within this created cooling air duct, the cooling air is repeatedly deflected, thus achieving very good heat transfer. Furthermore, this cooling duct, which, depending upon the size of the cooling ribs, may be divided into a plurality of arcuate or S-shaped sections, is very large since it is not obstructed by the bosses for the attachment bolts. According to some embodiments of the invention, there is provided a flow of cooling air in the vicinity of the exhaust valve or exhaust duct in the cover plate section also, the flow comprising a partial flow of air arriving linearly and a partial flow of air passing over ribs obliquely arranged, namely, ones positioned at an acute angle to the cylinder axis, in the cover plate section. The partial flow of air passing over the obliquely arranged ribs is branched off the main flow of air.

By arranging additional V-shaped and parallel ribs in the cover plate section on the exhaust air side, according to a further embodiment, and by arranging fairings on the exhaust air side, according to a still further embodiment, parts of the arcuate or S-shaped main cooling air flow are also guided on the exhaust air side, in the area below the exhaust duct, to the cover plate section. To this end, the external contour of the cylinder head section facing away from the cylinder is also recessed in relation to the cooling ribs below the exhaust duct, thus allowing an adequately large flow of air to reach these ribs. This is also assisted by the extension and bending of the fairings along the upper edges of the cylinder heads, according to a further embodiment, and by the configurations shown in the drawings. Bending the fairings on the exhaust air side and selecting suitable flow though spacing to the exhaust duct contour, to the next fairing, and to the edges of the cylinder heads facing the cylinders, ensures that the cooling air is accurately guided and metered until it leaves the cylinder heads. To this end, the fairings also comprise recesses in the area of the cover plate section between two cylinder heads. The air guided between the cover plate sections can thus emerge through these recesses.

Tests have shown that the central area between the inlet and exhaust ducts may be made integral with the cylinder head, i.e., solid and without interruption, and that the injection nozzle located in this area is adequately cooled. Due to the satisfactory cooling provided, no further cooling is necessary. If, contrary to expectations, this central area should need additional cooling, it is quite possible to provide it with cooling ribs or coolant ducts. If desired, it is possible to provide a recess between the exhaust duct and the central area, or between the central area and the inlet duct.

Since the main cooling air duct between the cylinder heads is arcuate or S-shaped, it is offered, according to one embodiment, that the lateral deflectors shall have expansions corresponding to the guidance through each additional cylinder head. They are also advantageously connected, in one piece, with the corresponding part of the fairing.

The invention is illustrated by way of example in the accompanying drawings.

DETAILED DESCRIPTION OF THE PREFERRED EMBODIMENT

Figure 1:
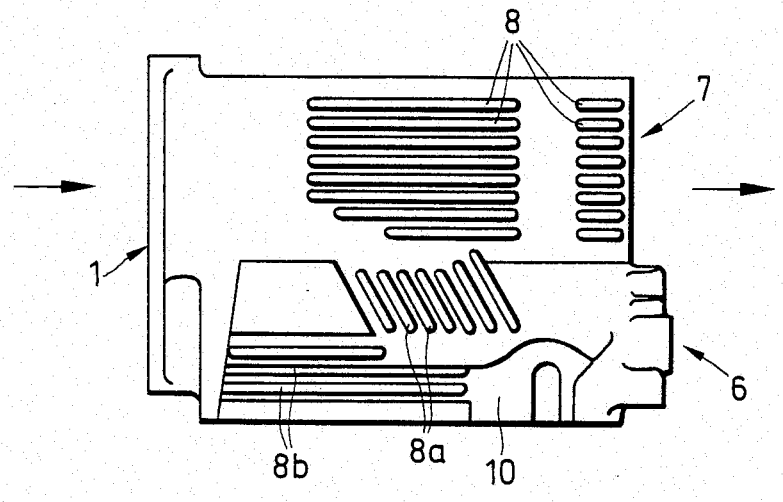
FIG. 1 is a side elevational view of an air-cooled cylinder head in accordance with the present invention.
Figure 2:
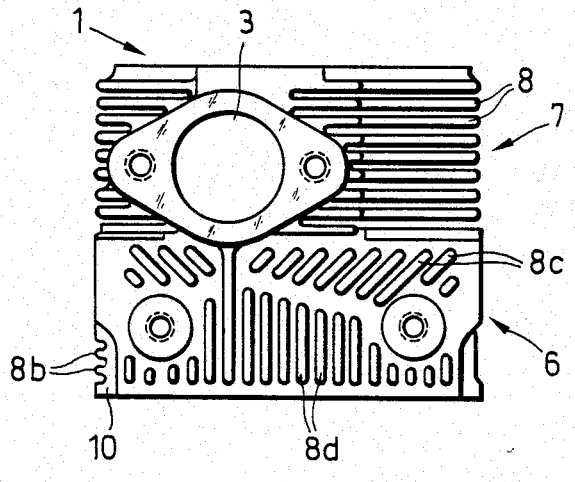
FIG. 2 is a view in the direction of the exhaust air side of the head, showing the exhaust duct flange of the cylinder head shown in FIG. 1.
Figure 3:
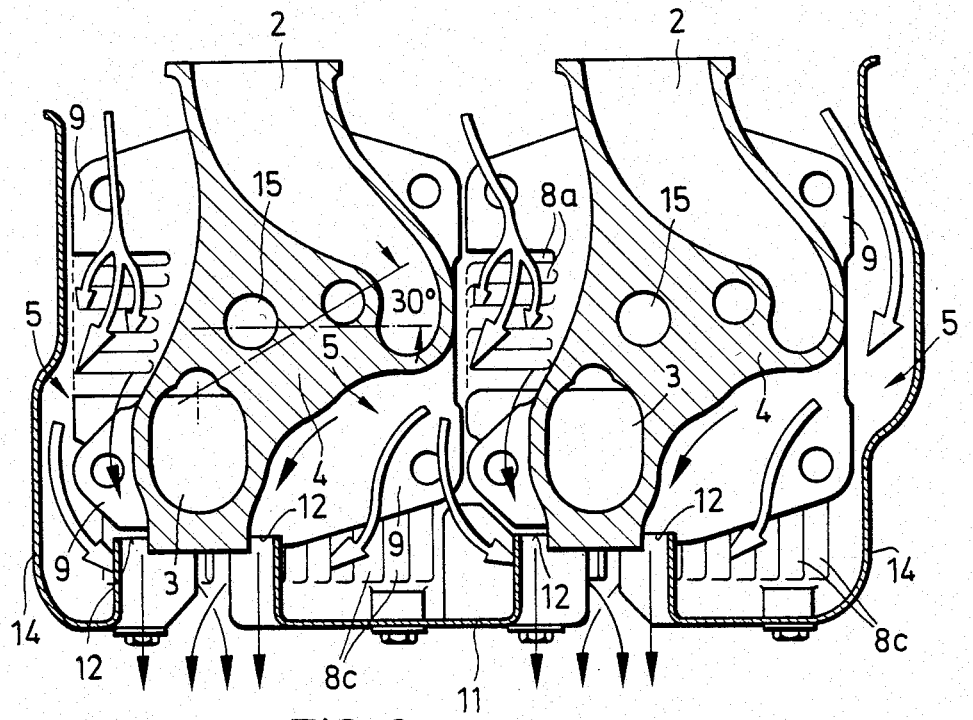
FIG. 3 is a cross sectional view through the lateral deflectors and fairings on the exhaust air side, and through the cylinder heads, along the line III—III in FIG. 5, with arrows indicating the flows of cooling and exhaust air.
Figure 4:
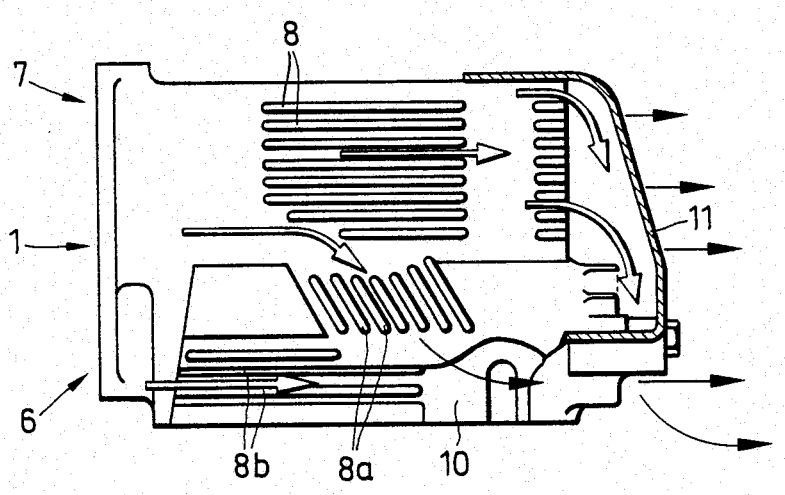
FIG. 4 is a side elevational view of the cylinder head shown in FIG. 1, with a cross section through a mounted fairing on the exhaust air side and arrows showing the flows of cooling and exhaust air.

In FIGS. 1 to 5, a single cylinder head 1 of an air-cooled, reciprocating piston internal combustion engine according to the present invention is shown. The exterior of the cylinder head is substantially cube-shaped and it comprises an inlet duct 2 and an exhaust duct 3, which are arranged on opposite sides of the cylinder head. The inlet and exhaust ducts include valves (not shown) and define openings at their ends facing the cylinder (not shown). The cylinder heads, when mounted, are swept by cooling air, as indicated in FIGS. 1, 3 and 4, which arrives at the inlet end of the inlet duct and leaves the cylinder heads on the exhaust duct side.

As shown more particularly in FIG. 3, the plane passing through the stems (not shown) of the valves lies at an acute angle of 30° in relation to the longitudinal axis of the internal combustion engine. The opening into inlet duct 2 is aligned with the center of the cylinder head and extends, merging into a swirl-shaped duct, to the lateral side of the cylinder head. Exhaust duct 3 extends, by the shortest path, outwardly, and therefore extends from a point offset in relation to the center of the cylinder head, at right angles to the exhaust air side of cylinder head 1. As also shown in FIG. 3, a central area 4 is provided between inlet duct 2 and exhaust duct 3, the central area being, in this embodiment of the invention, solid and integral with the cylinder head. The configuration of the cylinder head produces, in conjunction with an adjacently arranged cylinder head, an arcuate or S-shaped cooling air duct 5 in which the cooling air is repeatedly deflected and is therefore utilized to optimal effect. As may be seen more particularly from FIGS. 1 and 2, the cylinder head comprises a cover plate section or deck section 6 which, upon assembly, faces a cylinder (not shown) and is of substantially solid design, having little ribbing, and a cylinder head section or fin section 7. The latter comprises cooling ribs 8 arranged substantially perpendicularly to the axis of the cylinder and extending from ducts 2, 3 and central area 4 to the cube-shaped external contour of the cylinder heads. Cover plate section 6 has, at its corners, bosses 9 for accommodating attachment bolts shown in FIG. 5. As shown more particularly in FIGS. 1 and 4, the cover plate section comprises obliquely arranged ribs **8*a* extending at an acute angle to the axis of the cylinder. Arranged between ribs 8*a* and the cylinder (not shown) is a channel 10 having ribs 8*b*. As seen in FIGS. 1 and 4, channel 10 is expanded in the vicinity of the oblique ribs and the channel ribs, so that the combined partial flows of air can flow away from the heads, as shown in FIG. 4**. Depending upon the desired magnitude of the flows of cooling air through the lateral ribs on the cover plate section, the adjacent cylinder head may comprise a suitable recess on the adjacent side thereof.

As seen in FIG. 2, cover plate section 6 comprises ribs **8*c* on the exhaust air side extending V-shaped, at an acute angle to the axis of the cylinder, beneath exhaust duct 3. Almost adjoining ribs 8*c* are ribs 8*d*** extending parallel with the axes of the cylinders.

Figure 5:
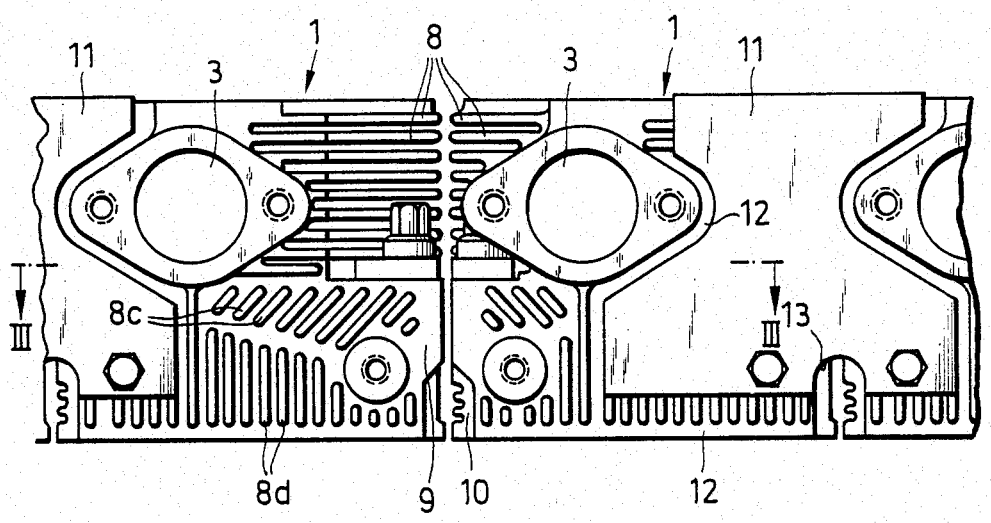
FIG. 5 is a view of a plurality of cylinder heads similar to that shown in FIG. 2, with fairings on the exhaust air side mounted and removed.

As also shown in FIGS. 3 and 4, incoming cold air (indicated by outlined arrows) is divided into a main air flow, flowing through the arcuate or S-shaped cooling air duct, and a partial air flow flowing laterally through the cover plate section. The cold air is heated by the walls of the cylinder head and passes out as hot air (solid arrows). Arranged on the exhaust air side, between each two cylinder heads is a fairing 11 which, as shown in FIG. 5, comprises, laterally and at the edges of the cylinder heads facing the cylinders, a flow through spacing whereby the volume of cooling air is throttled or choked for the purpose of ensuring satisfactory cooling of the cylinder head, and is also caused to flow completely around the exhaust air side. Between the two cylinder heads, seen in FIG. 5, fairing 11 has a recess 13 through which the flow of cooling air arriving from the lateral ribs on cover plate section 6 may emerge. In the vicinity of the upper edges of the cylinder heads, fairing 11 is bent round at right angles and follows the upper contour of the cylinder heads, best seen in FIG. 4. This provides an upper limit to the arcuate or S-shaped cooling air duct to the ribs on the exhaust air side of the cover plate section 6, below exhaust duct 3.

Deflectors 14 are provided for lateral guidance of the flows of cooling air at the end of each row of cylinders, the deflectors being shaped in such a manner that they relace the external contour of an adjacently arranged cylinder head and a part of the corresponding fairing, thus maintaining the arcuate or S-shaped cooling air duct.

This latter configuration of the cylinder heads produces overall highly satisfactory guidance of the flow of cooling air and excellent utilization thereof. Such makes it possible for the central area of the cylinder head to be solid. An injection nozzle for a self-igniting Diesel engine may thus be arranged in a bore 15 in the central area which is an optimal location from the point of view of combustion technology, and assures that the nozzle does not become overheated.

We claim:

1. In a air-cooled, reciprocating piston, internal combustion engine which defines a longitudinal axis and which includes at least one row of cylinders comprising individual cylinder heads arranged side-by-side, said cylinder heads being provided with cooling ribs extending substantially normal to the axes of the cylinders, said cylinder heads including means for accommodating attachment bolts, said cylinder heads each having at least one inlet valve and one exhaust valve, the valve stems of which extend substantially parallel to the axes of the cylinders and are situated such that the plane passing through said valve stems lies at an acute angle to said longitudinal axis of the internal combustion engine, said cylinder heads each including an intake duct located on a side thereof which is swept by cooling air, said intake duct having its inlet opening aligned approximately centrally of the cylinder head, said cylinder heads each including an exhaust duct extending substantially perpendicularly to the exhaust air side, and a lateral deflector being provided adjacent the end cylinder head in each row, the improvement wherein each of the cylinder heads includes a central area between the valve stems therein, and wherein each cylinder head is externally shaped to provide at least one arcuate or S-shaped cooling air duct between it and an adjacent, similarly constructed cylinder head, and wherein each cylinder head includes an enclosed cover plate section facing the associated cylinder of the cylinder head, said enclosed cover plate being provided with cooling ribs at the cylinder head periphery, substantially on the exhaust air side thereof, and the side thereof facing the inlet valve stem, and includes boss means for accommodating attachment bolts.

2. The improvement as defined in claim 1, wherein ribs are obliquely arranged on the side of the cover plate section facing the inlet valve stem, in the central area of the cylinder head, said ribs extending at an acute angle to the axis of the cylinder, and in that a channel extending at right angles to the axis of the cylinder is provided between said ribs and the edge of the cylinder head abutting the cylinder, ribs being arranged in said channel and extending from the air inlet side to said obliquely arranged ribs, so that the flow of air through the channel and said cooling ribs unites with the flow of air through the obliquely arranged ribs, in the exhaust air direction.

3. The improvement as defined in claim 2, wherein on the side adjacent the inlet valve stem, in the cover plate section, the cylinder head comprises spaced recesses respective the channel, the channel ribs, and the obliquely arranged ribs.

4. The improvement as defined in claim 2, wherein the cooling ribs on the exhaust air side, at the periphery of the cover plate section, comprise V-shaped ribs extending at an acute angle to the axis of the cylinder, below the exhaust duct and above adjacent parallel spaced ribs extending parallel with the cylinder axis and extending to terminate adjacent the cylinder, said V-shaped and parallel spaced ribs being designed to project relative to said cooling ribs extending substantially normal to the axes of the cylinders and to the external contour of the cylinder head section facing away from the individual cylinder.

5. The improvement as defined in claim 1, wherein said central area is of solid design having no cooling ribs.

6. The improvement as defined in claim 1, wherein said central area includes cooling ribs, and wherein a recess is provided between said central area and said exhaust duct and intake duct.

7. The improvement as defined in claim 1, wherein a bore reception of the injection nozzle of a self-igniting Diesel engine is provided in said central area, between the valve stems, said bore being arranged approximately parallel therewith.

8. The improvement as defined in claim 1, wherein fairings are provided on the exhaust air side to define said arcuate or S-shaped cooling air ducts, said fairings providing a flow through space adjacent the contour of the exhaust duct, and extending to the next fairing, and downwardly to the edges, facing the cylinders, of the cylinder heads, as well as to a recess between them which extends from the edge, facing the cylinders, as far as the cover plate section.

9. The improvement as defined in claim 8, wherein in the vicinity of the upper edges of the cylinder heads the fairings are bent round approximately at right angles, so that they extend, following contours of the cylinder heads, in the direction of the flow of cooling air, and that they define upwardly, the arcuate or S-shaped cooling air ducts.

10. The improvement as defined in claim 8, wherein a baffle plate, covering said arcuate or S-shaped cooling air ducts, and engaging over a plurality of the heads, is provided along the upper edges of the cylinder heads.

11. The improvement as defined in claim 10, wherein the baffle plate comprises the lower part of a housing accommodating valve gear parts.

12. The improvement as defined in claim 1, wherein said lateral deflectors at said end cylinder heads are shaped, in the direction of the flow of cooling air, in such a manner as to produce cooling air ducts corresponding approximately to the cooling air ducts corresponding approximately to the cooling air ducts between any two cylinder heads, the deflector adjacent an inlet valve stem in this area, and the deflector arranged at the other end of a row of cylinders, in the vicinity of the exhaust duct, each comprising an expansion area, and in that the respective fairing parts, corresponding to the exhaust air area are integrally formed with said deflectors.

13. The improvement as defined in claim 12, wherein the fairings and the deflectors are bent at about 90°, adjacent their peripheral edges, in the area of the exhaust air side, so that said edges face toward the cylinder heads.

* * * * *